US007981479B2

(12) United States Patent
Lawrynowicz et al.

(10) Patent No.: US 7,981,479 B2
(45) **Date of Patent: *Jul. 19, 2011**

(54) MULTI-STATION ROTATION SYSTEM FOR USE IN SPRAY OPERATIONS

(75) Inventors: Daniel E. Lawrynowicz, Monroe, NY (US); Aiguo Wang, Wayne, NJ (US); Zongtao Zhang, Riverdale, NJ (US); Jay Krajewski, Coventry, CT (US)

(73) Assignees: Howmedica Osteonics Corp., Mahwah, NJ (US); Inframat Corporation, Farmington, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/785,675

(22) Filed: May 24, 2010

(65) Prior Publication Data

US 2010/0266780 A1 Oct. 21, 2010

Related U.S. Application Data

(63) Continuation-in-part of application No. 11/356,671, filed on Feb. 17, 2006, now Pat. No. 7,836,847.

(51) Int. Cl.
*B05C 11/10* (2006.01)

(52) U.S. Cl. ..... 427/427.2; 118/666; 118/669; 118/679; 118/682; 118/686; 118/687

(58) Field of Classification Search ..... 156/666, 156/669, 679, 682, 686, 687, 302, 319, 320, 156/321, 323

See application file for complete search history.

(56) References Cited

U.S. PATENT DOCUMENTS

| | | | |
|---|---|---|---|
| 2,048,276 | A | 7/1936 | Marlies |
| 2,330,880 | A | 10/1943 | Gladfelter et al. |
| 2,365,259 | A | 12/1944 | Fischer |
| 2,970,773 | A | 2/1961 | Keryluk et al. |
| 3,368,914 | A | 2/1968 | Darnell |
| 3,384,048 | A | 5/1968 | Kutcher |
| 3,971,633 | A | 7/1976 | Wolfla et al. |
| 4,056,644 | A | 11/1977 | Howard et al. |
| 4,309,261 | A | 1/1982 | Harding et al. |
| 4,334,927 | A | 6/1982 | Hyde et al. |
| 4,384,907 | A | 5/1983 | Aidlin et al. |
| 4,640,846 | A | 2/1987 | Kuo |

(Continued)

FOREIGN PATENT DOCUMENTS

EP 18612 A1 11/1980

(Continued)

*Primary Examiner* — George R Koch, III

(74) *Attorney, Agent, or Firm* — Lerner, David, Littenberg, Krumholz & Mentlik, LLP

(57) ABSTRACT

A system and method for use in applying a coating of a desired material onto one or more medical implant components. The system may include one or more thermal sprayers and a rotatable holding fixture having a plurality of mounting stations each operable to hold at least one medical implant component. The fixture may be operable to rotate about a central axis and each mounting station may be operable to rotate about a respective mounting station axis. The fixture may be arranged adjacent to one or more thermal sprayers so that during operation one or more desired materials may be sprayed by the one or more thermal sprayers upon an outer surface of each of the medical implant components while the fixture rotates about the central axis and while simultaneously therewith each of mounting stations having a respective medical implant component rotates about the respective mounting station axis.

16 Claims, 8 Drawing Sheets

U.S. PATENT DOCUMENTS 4,974,716 A 12/1990 Yuri et al.
5,326,645 A 7/1994 Ashary et al.
5,370,694 A 12/1994 Davidson
5,480,438 A 1/1996 Arima et al.
5,624,496 A 4/1997 Scharf et al.
5,665,262 A 9/1997 Hajaligol et al.
5,759,268 A 6/1998 Begin et al.
5,807,407 A * 9/1998 England et al. ..... 128/898
5,868,796 A 2/1999 Buechel et al.
5,989,644 A 11/1999 Williams
6,087,022 A 7/2000 Burris et al.
6,102,777 A 8/2000 Duescher et al.
6,149,814 A 11/2000 Allington et al.
6,302,961 B1 10/2001 Robie et al.
6,425,922 B1 7/2002 Pope et al.
6,436,189 B1 8/2002 Reuscher
6,482,476 B1 11/2002 Liu
6,488,715 B1 12/2002 Pope et al.
6,554,924 B2 4/2003 Morrow et al.
6,562,136 B1 * 5/2003 Chappa et al. ..... 118/500
6,607,850 B2 8/2003 Wang et al.
6,652,588 B2 11/2003 Hayes, Jr. et al.
6,680,129 B2 1/2004 Wang et al.
6,709,514 B1 3/2004 Hossainy
6,783,793 B1 8/2004 Hossainy et al.
6,800,095 B1 10/2004 Pope et al.
6,881,229 B2 4/2005 Khandkar et al.
7,001,672 B2 2/2006 Justin et al.
7,001,675 B2 2/2006 Chan
7,179,526 B2 2/2007 Rosenflanz et al.
2002/0052659 A1 5/2002 Hayes et al.
2002/0111694 A1 8/2002 Ellingsen et al.
2003/0041924 A1 3/2003 Dearnaley et al.
2003/0045941 A1 3/2003 Lewallen
2003/0143315 A1 7/2003 Pui et al.
2003/0171820 A1 9/2003 Wilshaw et al.
2004/0002766 A1 1/2004 Hunter et al.
2004/0043230 A1 3/2004 Hatono et al.
2004/0122524 A1 6/2004 Hunter et al.
2004/0133283 A1 7/2004 Shetty
2004/0153165 A1 8/2004 Li et al.
2004/0167612 A1 8/2004 Grignani et al.
2004/0209001 A1 * 10/2004 Anderson et al. ..... 427/446
2004/0211362 A1 10/2004 Castro et al.
2004/0261698 A1 12/2004 Roorda et al.
2004/0267371 A1 12/2004 Hayes et al.
2005/0069630 A1 3/2005 Fox et al.
2005/0079274 A1 4/2005 Palasis et al.
2005/0102034 A1 5/2005 Hayes et al.
2005/0107870 A1 5/2005 Wang et al.
2005/0118939 A1 6/2005 Duescher
2005/0158450 A1 7/2005 Palasis et al.
2005/0167261 A1 8/2005 Deutchman et al.
2005/0187140 A1 8/2005 Hunter et al.
2005/0203630 A1 9/2005 Pope et al.
2005/0234152 A1 10/2005 Ramsey
2006/0041047 A1 2/2006 Ramsey
2006/0052880 A1 * 3/2006 Brosnahan et al. ..... 623/23.39
2006/0184251 A1 8/2006 Zhang et al.
2007/0193509 A1 * 8/2007 Lawrynowicz et al. ..... 118/321

FOREIGN PATENT DOCUMENTS

JP 63088824 A 4/1988

* cited by examiner

MULTI-STATION ROTATION SYSTEM FOR USE IN SPRAY OPERATIONS

CROSS REFERENCE TO RELATED APPLICATION

This application is a continuation-in-part of U.S. patent application Ser. No. 11/356,671 filed Feb. 17, 2006, now U.S. Pat. No. 7,836,847, the disclosure of which is hereby incorporated herein by reference.

FIELD OF INVENTION

The present invention relates to a system and method for enabling material to be sprayed onto a component and, more particularly, to such system and method which enables material to be sprayed onto a plurality of components, such as a plurality of medical implant components.

BACKGROUND OF THE INVENTION

Typically, in performing a spray operation, such as a thermal spray operation, a component or part (such as a medical implant component) is placed on a holding fixture which is operable to rotate. Examples of a thermal spray operation may include a plasma spray operation, a high velocity oxygen fuel (HVOF) spray operation, and so forth. While the holding fixture and the medical implant component rotate, a desired material is sprayed onto the outer surface of the medical implant component so as to form a coating layer by use of a spray gun, such as a thermal or plasma type spray gun.

One type of holding fixture holds a single medical implant component in the center thereof. During a spray operation, such type of fixture rotates causing the medical implant component to also rotate. Another type of holding fixture may hold a plurality of medical implant components. In such other type of fixture, the medical implant components may be moved or rotated so that a respective medical implant component may be indexed into a spray position adjacent to the spray gun. Thereafter, the fixture may cause the respective medical implant component to be rotated about a respective axis, while such medical implant component is sprayed. During such rotation and spraying of the respective medical implant component, the other medical implant components are kept stationary. In other words, in this type of holding fixture, all of the medical implant components may be moved or rotated while one such component is being indexed, but when the respective medical implant component is rotated and being sprayed the other medical implant components do not move or rotate.

In a thermal or plasma spraying operation, the particles of the spray material may be heated to a relatively high temperature (such as 0.7 to 0.9 of its melting point or even at or higher than its melting point). For example, if the spray material is chromium oxide ($Cr_2O_3$), it may be heated to a temperature higher than its melting point of approximately 2450 degrees Centigrade during such thermal spraying operation. As a result, the temperature of the coating layer of the medical implant component may be relatively high. Although the rotation of the medical implant component on the holding fixture during the spraying process may help to cool most of the outer surface or coating layer of the implant component by convection, at least one part thereof may not be cooled due to such rotation. More specifically, if a medical implant component, such as a symmetrically shaped femoral head, is placed on either of the types of holding fixtures previously described, the top center of the femoral head does not move while being rotated during the spray process. Instead, during such rotation, the top center of the femoral head remains in the same location. Accordingly, since the top center of the medical implant component does not move during the spray process, such portion may not be cooled by convection. As a result, localized over-heating may occur which, in turn, may cause cracking of the coating layer of the medical implant component.

To minimize over-heating, the spraying could be stopped or interrupted after each pass so as to allow the coating layer to cool. Although this method may minimize or reduce over-heating of the coating layer during a spraying process, such method may increase the cost of the spraying operation. That is, if the coating layer is allowed to cool between each pass, the time or duration of the spraying process is increased. Such increased time may result in increased cost.

In addition to localized high temperatures, other factors may also cause cracking in the coating layer. More specifically, cracking in the coating layer may occur when the residual stress ($\sigma_R$) is greater than the coating strength. The residual stress ($\sigma_R$) may be equal to:

$$\sigma_R = E(\alpha_c - \alpha_m)(\Delta T) f_1(\text{coating layer thickness}) f_2(\text{shape}) f_3(\text{thermal conductivity}) \quad \text{(Eq. 1)}$$

in which E is the modulus of elasticity of the coating material, $\alpha_c$ is the coefficient of thermal expansion of the coating material, $\alpha_m$ is the coefficient of thermal expansion of the material or metal of the substrate of the medical implant component, $\Delta T$ is the difference between room temperature and a pre-heat temperature of the substrate during the spray operation, $f_1$ (coating layer thickness) is a function relating to the total thickness of the coating layer and/or the thickness of the coating material applied per pass, $f_2$ (shape) is a function relating to the shape of the component, and $f_3$ (thermal conductivity) is a function relating to the thermal conductivity of the substrate material and/or the coating material. As a result, one or more factors such as the difference between room temperature and the pre-heat temperature of the substrate during the spray operation, the total thickness of the coating layer, the thickness of the coating material applied per pass, the shape of the component (e.g., whether the component has a sharp corner or a curved surface with a relatively large or small radius), the value(s) of the thermal conductivity of the substrate material and/or the coating material, and the difference in the thermal coefficient of expansion for the coating material and that of the substrate material, may cause cracks to develop in the coating layer. For example, cracking of the coating layer may occur if too much spray material is applied within a pass or within a given time interval.

Accordingly, to avoid cracks from occurring in the coating layer a number of parameters may be followed. For example, (i) the materials for the coating layer and the substrate may be selected such that the difference in the thermal coefficients of expansion of such materials is less than a predetermined value, such as less than approximately $1.0\times10^{-6}$/degree Centigrade, and such that the thermal conductivity thereof have acceptable values, (ii) the component or the surfaces thereof to be sprayed may be designed such that sharp corners are avoided and curved surfaces have a relatively large diameter, such as equal to or greater than approximately 42 millimeters, (iii) the total thickness of the sprayed material and/or the thickness of material sprayed or applied during each pass may be less than a predetermined value, and (iv) the temperature of the substrate and/or coating layer may be controlled such that the difference in temperature ($\Delta T$) of the substrate during the spray process may be maintained so as not to exceed a predetermined value.

As is to be appreciated, it may be difficult to vary the elements of items (i) and (ii) above so as to provide the most acceptable situation. That is, the shape of the component (along with the surface or surfaces thereof to be coated) may be substantially fixed due to the actual size of the bones and so forth of a patient; and, the materials for the substrate and the coating layer may be selected so as to satisfy other objectives, such as long term wear, biocompatibility, lack of noise during use, and so forth. However, the elements of items (iii) and (iv) may be more easily varied to obtain an acceptable situation.

As such, it would be advantageous to provide a system which would enable components (such as medical implant components) to be sprayed with a desired material by a thermal or plasma type spraying process or the like which would control the amount of materials which are sprayed such that the total thickness of such material applied and/or the thickness of such material applied per pass does not exceed a predetermined value, and which would maintain the pre-heat temperature and/or the difference in temperature ($\Delta T$). Additionally, it would also be advantageous to provide such system which would operate in a cost efficient manner.

SUMMARY OF THE INVENTION

In accordance with an aspect of the present invention, a system for use in applying a coating of one or more desired materials onto one or more medical implant components is provided. The system may include a plurality of thermal sprayers, and a rotatable holding fixture having a plurality of mounting stations each operable to securely hold at least one component. The fixture may be operable to rotate about a central axis and each of the stations may be operable to rotate about a respective mounting station axis, where the central axis may be removed from each mounting station axis. Each of the plurality of thermal sprayers may be operable to spray at least one desired material upon at least one of the components, while the fixture rotates about its central axis and while simultaneously therewith the at least one of the mounting stations rotates about its respective mounting station axis.

The system may further include at least one feeder for supplying at least one desired material to one or more of the thermal sprayers.

In accordance with another aspect of the present invention, a method for applying a coating of a desired material onto at least one component includes rotating a rotatable holding fixture about a central axis, where the fixture is adapted for securely holding a plurality of components on respective mounting stations and the central axis of the fixture is removed from mounting station axes of the respective mounting stations. In addition, at least one of the mounting stations having the respective component secured thereto is rotated about a respective mounting station axis. Further, a plurality of thermal sprayers is operated to spray at least one desired material upon at least one of the components, while the respective mounting station onto which the at least one component is secured is rotating about its station axis.

In one embodiment, at least one of the plurality of thermal sprayers is operated to sequentially spray at least one first material, at least one second material and at least one third material onto at least one of the components. The first, second and third materials include at least one composition having first, second and third coefficients of thermal expansion ("COE"), respectively. In one desired embodiment, the first COE is less than the second and third COEs, the second COE is between the first and third COEs, and an outer surface of the at least one component onto which the at least first material is sprayed has a COE closer to the first COE than to the second COE. In another desired embodiment, the outer surface of the at least one component has a COE greater than the first, second and third COEs, the first COE is greater than the second and third COEs, and the second COE is greater than the third COE.

In a further embodiment, the fixture may be rotated about the central axis in a plurality of steps, so that the fixture is stationary for a predetermined interval between successive steps. Each of the components may be positioned during three intervals, in relation to at least one of the plurality of thermal sprayers, to permit spraying of material by the at least one of the plurality of thermal sprayers onto each of the components. The at least one of the plurality of thermal sprayers may be operated to sequentially spray the at least one first material, the at least one second material and the at least one third material onto each of the components during the respective three intervals in which each of the components is positioned to permit spraying of material by the at least one of the plurality of thermal sprayers onto each of the components.

In accordance with another aspect of the invention, a system for use in applying a coating of one or more desired materials onto one or more components may include a thermal sprayer, and a rotatable holding fixture having a plurality of mounting stations each operable to securely hold at least one component. The fixture may be operable to rotate about a central axis and each of the stations may be operable to rotate about a respective mounting station axis, where the central axis may be removed from each mounting station axis. The system further may include a plurality of feeders for respectively supplying a plurality of desired materials to the thermal sprayer. The thermal sprayer is operable to spray the plurality of desired materials supplied from the respective plurality of feeders upon at least one of the components, while the fixture rotates about its central axis and while simultaneously therewith at least one of the mounting stations holding a respective at least one of the components rotates about its respective mounting station axis.

In one embodiment, the desired material in one of the feeders is different from, or at a different temperature than, the desired material in another of the feeders.

In accordance with another aspect of the present invention, a method for applying a coating onto at least one component includes rotating a rotatable holding fixture about a central axis, where the fixture is adapted for securely holding a plurality of components on a respective plurality of mounting stations. In addition, the method may include rotating at least one of the mounting stations about a respective mounting station axis, where the central axis of the fixture is removed from the mounting station axes of the respective mounting stations. Further, the method may include supplying a plurality of desired materials from a respective plurality of feeders to a thermal sprayer. The thermal sprayer may be operated to spray the plurality of desired materials upon at least one of the components, while the respective mounting station onto which the at least one component is secured is rotating about its station axis.

In one embodiment, the thermal sprayer may be operated to sequentially spray at least one first material, at least one second material and at least one third material supplied respectively from first, second and third of the feeders onto at least one of the components. The first, second and third materials may include at least one composition having first, second and third coefficients of thermal expansion ("COE"), respectively, where the first COE is less than the second and third COEs, the second COE is between the first and third COEs, and an outer surface of the at least one component onto which the at least first material is sprayed has a COE closer to the first COE than to the second COE.

BRIEF DESCRIPTION OF THE DRAWINGS

A more complete appreciation of the subject matter of the present invention and the various advantages thereof can be realized by reference to the following detailed description in which reference is made to the accompanying drawings wherein like reference numbers or characters refer to similar elements.

DETAILED DESCRIPTION

Figure 1:
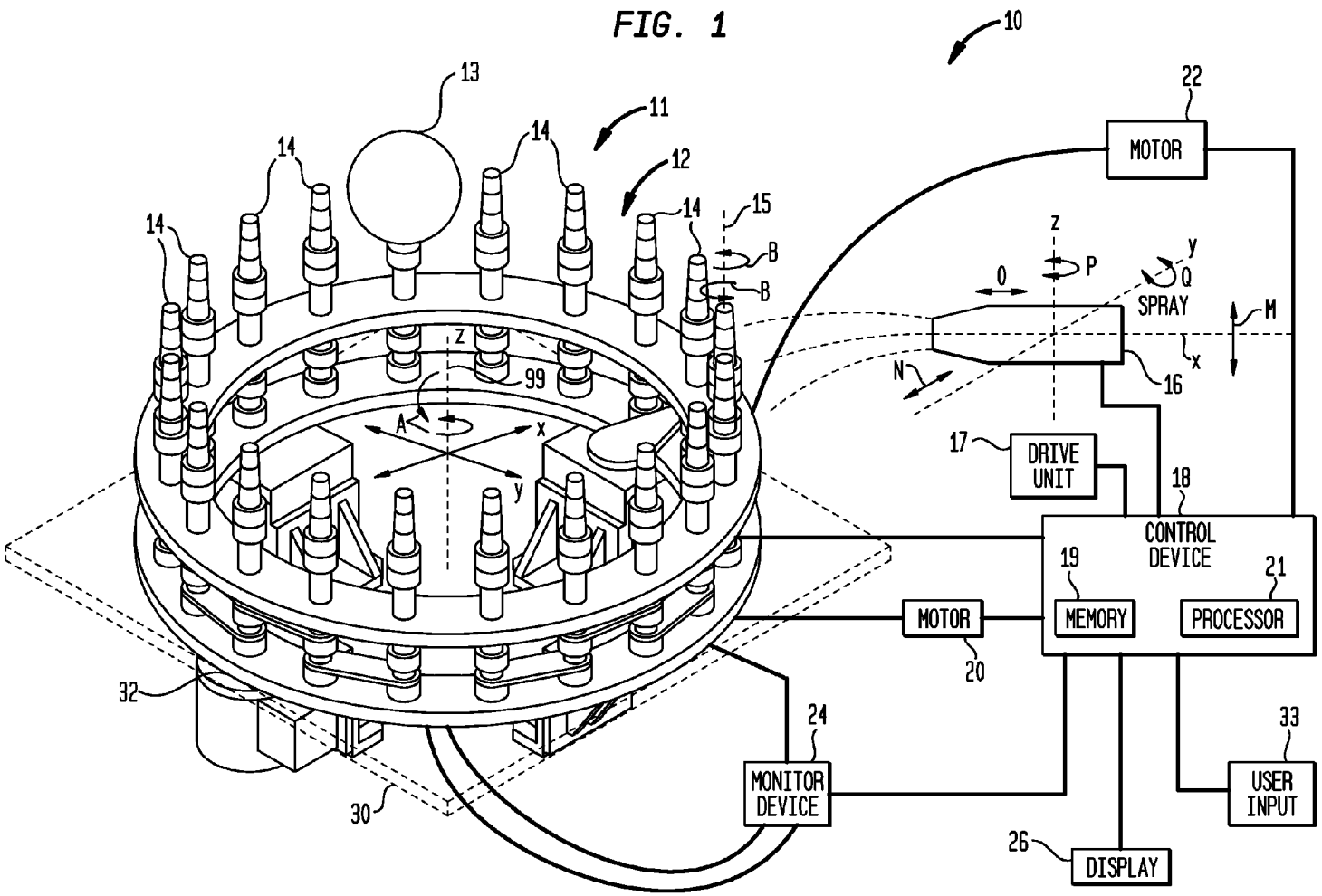
FIG. 1 is a diagram of a multi-station rotation system according to an embodiment of the present invention.

A system 10 for enabling a plurality of components, such as medical implant components, to be sprayed with a desired material in accordance with an embodiment of the present invention is illustrated in FIG. 1. As shown therein, such system may generally include a holding assembly 11, a spray device 16, and a control device 18.

The holding assembly 11 may include a rotatable holding fixture 12 and a stationary housing 30. The holding fixture 12 may be configured so as to have a generally circular shape and may be adapted to rotate relative to the stationary housing 30 about a central Z-axis 99 in either one or both of a clockwise direction and a counter-clockwise direction, as indicated by arrows A. More specifically, the holding fixture 12 may include one or more circular-shaped rings which are rotatably coupled to the stationary housing 30. A motor 20 may be connected to the holding fixture 12 so as to cause the holding fixture to rotate about the central Z-axis 99. The motor 20 may be an AC powered type motor or, alternatively, may include its own power source. Further, the motor 20 may be connected to the control device 18 so as to receive control signals therefrom. Such control signals may control one or more of the speed, acceleration, deceleration, dwell times, rotational direction, and/or other operational parameters of the holding fixture 12. The holding fixture 12 and/or the housing 30 may be fabricated from stainless steel or similar type material.

Although the motor 20 is shown in FIG. 1 as being located remote from the holding fixture 12, the present invention is not so limited. Alternatively, the motor 20 may be integrally arranged with the holding assembly 11 and/or the holding fixture 12.

The holding fixture 12 may include a plurality of mounting stations 14 which may be arranged near the periphery of the holding fixture as, for example, shown in FIG. 1. Each such mounting station 14 may be adapted to securely hold one or more components (such as medical implant components). Additionally, each mounting station may be adapted to rotate about a longitudinal individual or mounting station axis 15 unique to each mounting station in a clockwise and/or counter-clockwise direction, as indicated by arrows B in FIG. 1. The central Z-axis 99 may be removed from each individual or mounting station axis 15. Additionally, the central Z-axis 99 and each mounting station axis 15 may be parallel or substantially parallel to each other. Alternatively, the central Z-axis 99 and each mounting station axis 15 may not be parallel to each other. As yet another alternative, the central Z-axis 99 may be parallel or substantially parallel to one or more of the mounting station axes 15 and not parallel to one or more other mounting station axes 15. In either of the later two situations, the mounting station axis or axes 15 may be at any angle or angles other than 90 degrees (or a right angle) relative to the X-Y plane.

A connecting mechanism 32 may couple a number or all of the mounting stations 14 together so that such mounting stations may be rotatably driven simultaneously. Such connecting mechanism 32 may include a gear train arrangement, a pulley type arrangement, or other mechanical coupling type arrangement. The connecting mechanism 32 may be coupled to a motor 22. As a result, the motor 22 may drive the connecting mechanism 32 which, in turn, may drive each of the mounting stations connected thereto. Alternatively, instead of using the connecting mechanism to drive the mounting stations, each mounting station may have its own motor directly coupled thereto so as to enable each mounting station to be driven independently of each other. Such arrangement may enable any number or all of the mounting stations to be driven simultaneously with each other or in a non-simultaneous manner.

Although the holding fixture 12 is shown with twenty (20) mounting stations 14, the present invention is not so limited. Alternatively, the present invention may include a holding fixture having any number of mounting stations. For example, the holding fixture may have 2, 3, 4, 5, 6, 7, 8 . . . or more mounting stations.

The spray device 16 may be positioned adjacent to the holding fixture 12 so as to be able to spray a desired material onto the desired surface or surfaces of the medical implant component or components held by the mounting stations 14. The spray device 16 may include a thermal or plasma type spray gun. The spray gun may be adapted to move in a number of ways such as in one or more of the following: in an upward/downward direction along the Z-axis as indicated by arrows M, in a side-to-side direction along the Y-axis as indicated by arrows N, in a towards/away from direction along the X-axis as indicated by arrows O, in a rotational manner about the Z-axis as indicated by arrows P, and/or in a rotational manner about the Y-axis as indicated by arrows Q. The spray device 16 may be coupled to a drive unit 17 which, in turn, may be coupled to the control device 18. Additionally, the spray device 16 may be directly coupled to the control device 18. The control device 18 may generate a control signal or signals in a manner as more fully described herein below, and may supply the same to the spray device 16 and/or the drive unit 17. More specifically, the control device 18 may generate a drive control signal and may supply the same to the drive unit 17, whereupon in response thereto, the drive unit 17 may form a corresponding drive signal and supply the same to the spray device 16. Upon receipt of such drive signal, the spray device 16 or spray gun may be moved accordingly. As an example, the drive signal(s) from the drive unit 17 may control the angular and/or linear or straight line movement of the spray device 16 or spray gun. Further, the control device 18 may generate an operational control signal or signals and may supply the same to the spray device 16, whereupon in response thereto, the spray device may operate accordingly. As an example, the operational control signal from the control device 18 may control the rate at which the desired material is sprayed, the time or duration of spraying, and/or other operational parameters of the spray device.

In addition to the spray device 16 and the drive unit 17, the control device 18 may be coupled to the motor 20, the motor 22, a monitor device(s) 24, a display 26, and a user input 33. Further, the control device 18 may include a memory 19 and a processor 21. An operating program may be stored in the memory 19. Such operating program may include a control algorithm, a look-up table or the like and may be utilized to generate a control signal or signals and to cause the same to be supplied to the appropriate one or ones of the devices of the system 10. Additionally, the control device 18 may be adapted to receive a feedback or informational signal or signals from one or more of the devices of the system 10. In response to such feedback or informational signal(s), the control device 18 may generate an adjustment control signal or signals and supply the same to the appropriate one or ones of the devices in the system 10. For example, in response to a user command supplied by way of the input 33, the processor 21 may read the algorithm or look-up table from the memory 19 and use the same to generate a spray control signal and may supply the same to the drive unit 17. In response thereto, the drive unit 17 may generate a corresponding drive signal and supply the same to the spray device 16, whereupon the spray device and/or gun may be moved and/or rotated accordingly. A spray device feedback signal may be supplied from the spray device 16 to the control device 18. Such spray device feedback signal may provide an indication of the actual movement and/or rotation of the spray device or gun. The control device 18 may compare the actual movement and/or rotational information to the movement and/or rotation desired, and based upon the results of such comparison may generate an adjustment or correction signal and supply the same to the drive unit 17 so as to cause the movement and/or rotation of the spray device or gun to be adjusted accordingly.

The user input 33 may include a keyboard, mouse, and/or other input type devices and may be adapted to permit an operator to input desired commands and/or operational parameters. For example, the operator may use the input 33 to input an activation command to begin a spraying operation.

The system 10 may further include one or more monitor devices 24. Such monitor device(s) may be adapted to monitor one or more parameters of the system 10 and/or the medical implant components and to supply a signal indicative of the monitored value(s) to the control device 18. In response thereto, the control device 18 may determine whether or not the monitored value(s) are acceptable and if not, may generate an adjustment control signal and may supply the same to the appropriate one or ones of the devices of the system 10. Additionally, a signal indicative of the monitored value(s) may be supplied to a display 26, whereat an image representative thereof may be displayed so as to provide a visual indication of the monitored value(s) to the user or operator.

One or more of the monitor devices may be temperature monitor devices adapted to monitor the actual temperature of a selected one or ones of the medical implant components. Such temperature type monitoring device(s) may be operable to optically monitor the temperature of the desired medical implant component(s) by utilizing a light or laser type beam so as to avoid having any direct connection between the monitor device and the medical implant component(s). An example of such optical temperature monitor device is an infrared type temperature monitoring device.

Additionally, the temperature monitor device(s) may be operable to monitor the temperature of a selected or respective medical component at one, two, three, or more locations of such medical implant component. For example, the temperature monitor device(s) may monitor the actual temperatures at a location at or near the top of the medical implant component, at a location at or near the middle of the medical implant component, and at a location at or near the bottom of the medical implant component. Such temperatures may be combined and averaged, or alternatively, they may be kept separate. In either situation, the actual temperatures may be used to provide an indication of whether the system is performing acceptably during a spray operation and, if not, may be used to adjust the operation thereof. As an example, and as hereinafter further described, assume that the actual monitored temperatures are too high. In such situation, the control device 18 may receive a feedback signal from the temperature monitor device(s) indicating such high temperatures and, in response thereto, may generate an adjustment signal and cause the same to be supplied to the appropriate device or devices so as to cause the rotational speed of the holding fixture 12 and/or that of the respective mounting station(s) 14 to be adjusted. In addition and/or alternatively, the adjustment signal may cause heat or coolant to be added as in a manner as herein below described.

One or more of the monitor devices may be a velocity monitor device adapted to monitor the actual rotational velocity of the holding fixture, and/or the actual rotational velocity of a selected one or ones of the mounting stations 14 (or the medical implant components). In such monitoring of velocity, each mounting station or medical implant component may have a respective velocity monitor device associated therewith, and a separate velocity monitor device may be associated with the holding fixture 12. Alternatively, a fewer number of monitoring devices may be utilized to monitor the velocities of the medical implant components and the holding fixture 12. For example, one velocity monitor device may be utilized to monitor the velocities of all of the medical implant components and another velocity monitor device may be utilized for monitoring the velocity of the holding fixture 12.

The velocity monitoring device(s) 24 may include a sensor portion (such as a rotary type sensor, a piezoelectric type sensor, and so forth) which may be coupled to a respective item (e.g., a mounting station and/or the respective medical implant component coupled thereto) and a receiving portion for receiving a signal from the sensor portion or portions. Such receiving portion may be directly coupled to the sensor portion(s), in which case the signals therefrom may be transmitted by wires or the like to the receiving portion. Alternatively, the receiving portion and the sensor portion(s) may not be directly coupled to each other, in which case the signals from the sensor portion(s) may be transmitted wirelessly to the receiving portion.

Figure 2:
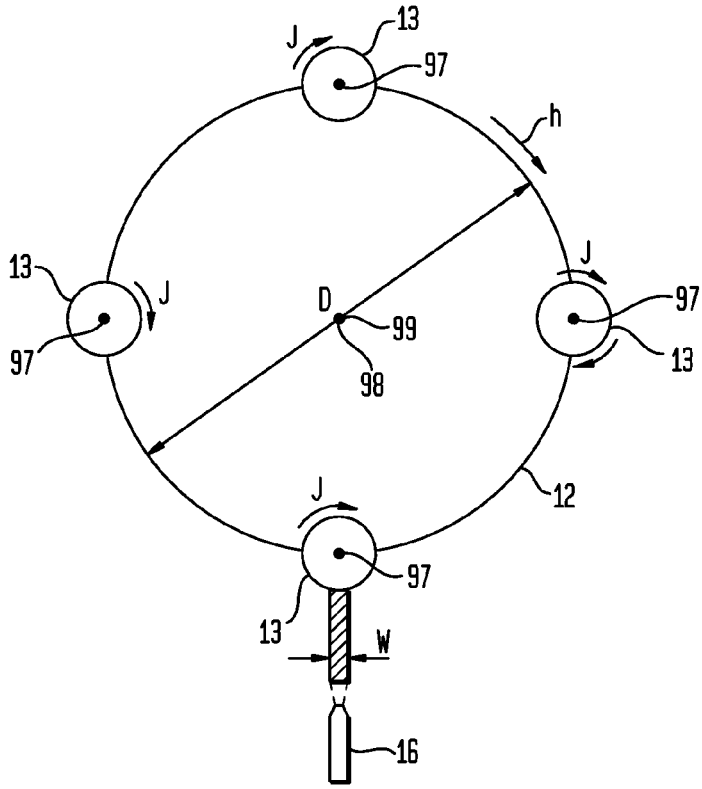
FIG. 2 is a diagram to which reference will be made in describing an operating scenario of the present multi-station rotation system.

FIG. 2 illustrates a diagram depicting an operating scenario for the system 10. That is, in the scenario shown in FIG. 2, holding fixture 12 may rotate in a clockwise direction about its center 98 (Z-axis 99 may pass through center 98), and each of the components 13 (each mounted onto a respective mounting station 14) may rotate in a clockwise direction about a respective longitudinal axis passing through its individual center 97, in which each such individual longitudinal axis may be removed from the Z-axis 99. Additionally, the central Z-axis 99 and each mounting station axis 15 may be parallel to or not parallel to each other. As is to be appreciated, although the holding fixture in FIG. 2 has four mounting stations 14, the present invention is not so limited. That is, and as previously indicated, the holding fixture may have any number of mounting stations. Furthermore, the present invention is not limited to the specific scenario illustrated in FIG. 2. Instead, the present invention may also operate in a plurality of other scenarios. For example, the holding fixture may rotate in a counter-clockwise direction and each component may rotate in a clockwise direction; the holding fixture may rotate in a clockwise direction and each component may rotate in a counter-clockwise direction, the holding fixture may rotate in a counter-clockwise direction and a first number of components may rotate in a clockwise direction and a second number of components may rotate in a counter-clockwise direction, and/or the holding fixture may rotate in a clockwise direction and a first number of components may rotate in a clockwise direction and a second number of components may rotate in a counter-clockwise direction.

During a spray operation, a number of operating parameters may be utilized and/or monitored and/or controlled so as to maintain an acceptable condition. An acceptable condition may be determined in accordance with the elements of equation 1. For example, it may be desirable to maintain the thickness of material applied per pass to a value which does not exceed a predetermined value. As an example, such predetermined value may be equal to approximately 12.5 micrometers/pass for a particular spray material such as $Cr_2O_3$ or $Al_2O_3$. The predetermined thickness per pass value may be dependent upon a number of factors, such as the particular spray gun, the spray material, the pressure of the area wherein the spray process is being performed (e.g., is it at atmospheric pressure, vacuum, in-between atmospheric pressure and vacuum, or higher than atmospheric pressure), the gas utilized in the spray process, and so forth. With regard to the pressure factor, and as an example, the predetermined thickness per pass value for a spray process performed in a vacuum may be one-half that when performed at atmospheric pressure. As another example, it may be desirable to maintain the temperature of the substrate and/or the coating layer to a value within a predetermined range such that the ($\Delta T$) value of equation 1 is maintained at an acceptable level.

The operating parameters which may be utilized to maintain the thickness per pass at the desired acceptable condition may include the rotational velocity (or speed) of the holding fixture 12, the individual rotational velocity (or speed) of the mounting stations 14 (or components), and the travel velocity (or speed) of the spray gun. The operating parameters which may be utilized to maintain the temperature of the substrate and/or the coating layer at an acceptable level may include the above parameters along with the actual temperature of the substrate and/or coating layer of the medical component. These parameters may be controlled in accordance with a predetermined formula and/or in a predetermined manner, as herein below more fully described. Such formula(s) may be included in the operational program stored in the memory 19 of the control device 18 and used in formulating the control signals for controlling the operation of one or more devices within the system 10.

With regard to control of the rotational velocity or speed of the holding fixture 12, the following formula may be utilized:

$$\text{Minimum Rotational Speed}_{holding\ fixture}=(\text{Linear Speed of Components})/(\pi)(\text{Diameter } D) \quad \text{(Eq. 2)}$$

wherein the linear speed of the components represents the speed at which cracking of the coating layer may be avoided during a thermal spray operation, and the diameter D is equal to twice the distance from center 97 of a respective mounting station 14 to center 98 of the holding fixture (see FIG. 2). Such linear speed may have a predetermined value such as approximately 150 feet/second. The diameter of a holding fixture having eight (8) mounting stations 14 may have a value of approximately 20 inches, and the diameter of a holding fixture having twenty (20) mounting stations 14 may have a value of approximately 30 inches. As a result, the minimum rotational speed for such 8 mounting station holding fixture is approximately 28.7 revolutions per minute (RPM), and that for such 20 mounting station holding fixture is approximately 19 RPM. It should be noted that these rotational speeds represent minimum values. Accordingly, the actual rotational speed of the holding fixture may be greater than these values. For example, an actual rotational speed for the 8 mounting station holding fixture may be approximately 50 RPM.

With regard to control of the rotational velocity or speed of the mounting station 14 (or component 13), and with reference to FIG. 2, the following formula may be utilized:

$$\text{Component rotational speed}=n(\pi)(D/w)(\text{Holding fixture rotational speed}) \quad \text{(Eq. 3)}$$

wherein n represents a number of revolutions of the component, D is equal to twice the distance from the center of a mounting station 14 to the center 98 of the holding fixture 12, and w represents the diameter or width of the flame of the particles projected from the spray device 16 (see FIG. 2). With further regard to n, the component rotational speed may have a value such that the component will turn either a full turn (or revolution) or at least one half of a turn while the component crosses the path of the plasma flame during a single revolution of the holding fixture 12. As a result, the coating may cover either the entire component or at least half of the component. Thus, n may have a value of 1 (which indicates that the component should turn one full revolution while the component crosses the path of the plasma flame during a single revolution of the holding fixture 12), or a value of 0.5 (which indicates that the component should turn one half of a revolution while the component crosses the path of the plasma flame during a single revolution of the holding fixture). As an example, consider the situation wherein D has a value of 20 inches (for the 8 mounting station holding fixture), the holding fixture rotational speed has a value of 50 RPM, w has a value of approximately 10 mm, and n has a value of 1 or 0.5. In such situation, the component rotational speed may have a value of approximately 7976 RPM (for n=1) and may have a value of approximately 3988 RPM (for n=0.5). If a value other than 1.0 for n is utilized, the path of the spray gun may be skewed so as to avoid the formation of a so-called node of the spray material on the surface of the component. For example, if n is equal to 1.0, then the path of the spray gun during a spray operation may lie within a plane formed by the Z and X axes (FIG. 1) or a plane parallel thereto; and, if n has a value other than 1.0, then the path of the spray gun may not lie within or parallel to such plane but instead may move in a skewed manner.

Figure 3A:
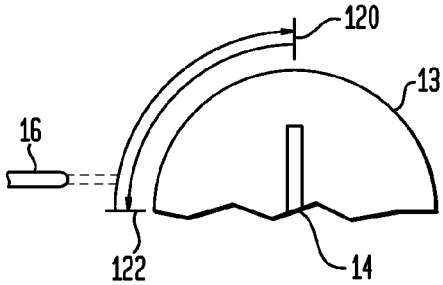
FIGS. 3*a* and 3*b* are diagrams to which reference will be made in explaining travel speed and distance of a spray gun.

With regard to the travel speed of the spray gun, such travel speed may be proportional to the rotational speed of the holding fixture 12 so as to maintain a sufficient amount of overlap of the coating during each revolution of the holding fixture 12. As an example, consider the situation wherein a ball portion of a femoral head component having a diameter of approximately 42 mm is being sprayed using the present system. Here, and with reference to FIGS. 3*a* and 3*b*, assume that the time for the spray gun to complete one pass of the component 13 is 1.0 minute, wherein one pass of the spray gun is from a bottom portion 122 of a component to a top portion 120 of a component or visa versa. Such time per pass is equal to the time for the spray gun to travel from top 120 to bottom 122 or visa versa. It should be noted that the thickness of the material applied per pass in this situation may be the thickness applied when the spray gun completes one pass (or travels from top 120 to bottom 122 or visa-versa). Additionally, the distance traveled by the spray gun from top 120 (or point 1 of FIG. 3*b*) to bottom 122 (or point 6 of FIG. 3*b*) is equal to ($\frac{1}{2}+\frac{25}{180}$) ($\pi$) or 115 degrees or ($\frac{1}{2}+\frac{25}{180}$) ($\pi$)(42 mm) or 84 mm. As a result of such time and distance, the average travel speed of the spray gun is 84 mm/minute or 1.4 mm/second (i.e., for a time per pass of 1 minute, $[\frac{1}{2}+\frac{25}{180}]\times(\pi)\times 42=84$ mm/minute). Further assume that the width or diameter of the plasma spray is approximately 10 mm, and the rotational speed of the holding fixture 12 is 50 RPM. For a rotational speed of 50 RPM, each revolution of the holding fixture takes 1.2 seconds. As a result, the distance traveled by the spray gun during such time may be equal to: (1.2 second)×(1.4 mm/second)=1.685 mm. Accordingly, the relationship of the spray gun travel speed to the holding fixture rotational speed may be 1.685 mm/RPM. As a result, the 10 mm wide coating may be overlapped 5.9 times. Thus, if the thickness of the coating applied per pass is 12.5 um, the amount of coating material applied per revolution of the holding fixture is approximately 2.1 um. Applying such relatively thin layer of coating material per revolution may ensure no, or substantially no, micro-cracks in the coating layer.

Further, the travel speed of the spray gun may be related to the feed rate of the spray material. That is, the spray gun may travel at a relatively fast rate when a relatively high material or powder feed rate is utilized so as to maintain the coating thickness per pass to a value which is equal to or less than a predetermined value (such as 12.5 um). For example, the spray gun may travel at a rate of approximately 84 mm/minute when the feed rate for the spray material is approximately 3.0 pounds/hour to 5.0 pounds/hour depending upon the deposition efficiency (DE).

Figure 3B:
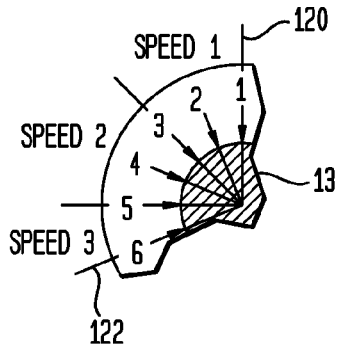

Additionally, the travel speed of the spray gun may vary. For example, and as illustrated in FIG. 3*b*, the travel speed may have three different values depending upon the portion of the component currently being sprayed. It should be noted that the variable speed of the spray gun is not so limited. That is, such variable travel speed of the spray gun may have two different values or four or more different values or may be continuously variable throughout its spray path.

With regard to the temperature of the component, the substrate thereof may be pre-heated to a predetermined temperature. Such temperature may have a value within the range of approximately 200 to 400 degrees Fahrenheit. Such temperature may also be maintained during the spray operation. In order to do so, heat may be added to the substrate. Such heat may be added by utilizing one or more additional thermal or plasma guns. The additional gun(s) may be utilized merely to add heat to the substrate (or substrates), and not to spray particles of the coating material. Accordingly, in this situation, the system 10 may include two (or more) spray guns, one for spraying the coating material onto the substrate(s) and one (or more) for applying additional heat to the substrate(s). Alternatively, other types of devices for adding heat may be utilized, such as an induction heating device, a heat lamp, a resistance heating device and so forth. Additionally, a device or devices may also be utilized to reduce the temperature of the substrate and/or coating layer. As an example, a liquid nitrogen type of device may be utilized to provide cooling. Furthermore, it should be noted that maintaining the substrate temperature at a high predetermined temperature (such as 350 degrees Fahrenheit) may improve the quality of the coating and/or may increase the deposition efficiency thereof. This predetermined substrate temperature may be dependent upon the spray material and/or the material of the substrate.

The rotational speed of the holding fixture may be adjusted such that the temperature of the components being sprayed is maintained at the desired temperature (such as 350 degrees Fahrenheit). As such, the present system provides a self-regulating temperature control system. Additionally, if the rotational speed of the holding fixture and that of the components which would enable the components when being sprayed to be maintained at the desired temperature were known, then there may not be a need to monitor the temperature of the component. In such a situation, the system could operate as an open loop system.

As an example, if during operation the temperature(s) of the medical implant components are too high, the control device may generate an adjustment control signal and may supply the same to the appropriate one or ones of the devices of the system 10. Such adjustment control signal may cause coolant to be added, increase the dwell or non-spray time, and/or increase the rotational velocity of the medical implant components and/or the holding fixture so as to increase convection cooling thereof.

Furthermore, the number of revolutions of the fixture or the mounting station(s) needed to ensure that each component is properly sprayed with the desired total thickness of spray material may be obtained. Such number of revolutions may be obtained based on the thickness per pass value and may be determined from an algorithm and/or a look-up table stored in the memory 19 of the control device 18.

An example of a spray operation with the spray parameters will now be provided. In such example, assume that a ball portion of a femoral head component is to be sprayed using the system 10 of FIG. 1. Here, eight (8) femoral head components may be mounted onto the mounting stations 14 of an eight component holding fixture, which may have a diameter D of 20 inches as previously indicated. By use of equations 2 and 3 above, the rotational speed of the holding fixture and that of the mounting stations (and components) may be obtained. Based upon such obtained values, the rotational speed of the holding fixture may be set to 50 RPMs and the rotational speed of each mounting station (and component) may be set to approximately 4000 RPMs. Afterwards, the number of revolutions needed to ensure that each component is properly sprayed with the desired total thickness of spray material may be obtained. Further, each of the components may be pre-heated to a temperature in the range of approximately 200 to 400 degrees Fahrenheit. Thereafter, the holding fixture may be rotated through the obtained number of revolutions so that the components may be sprayed to a desired total thickness, such as 350 microns.

In addition to above mentioned acceptable or desired conditions (i.e., coating layer thickness per pass and temperature of the substrate and/or the coating layer), other conditions may also be desired. For example, it may be desirable to maintain the ratio of the holding fixture rotational speed (equation 2) to the component rotational speed (equation 3) to a whole integer to avoid so-called nodes or build-up of spray material on the substrate and maintain uniform deposition. As another example, it may also be desirable to have a constant deposition rate over the surface being sprayed. (In other words, it may also be desirable to have the same amount of spray material at all spray locations on the component). With regard to maintaining a constant deposition rate, the movement of the spray gun may be controlled so that the deposition rate is kept constant regardless of the location of the part being coated. As such, if the component being sprayed is a spherical shaped component, then the deposition at the pole and any place on the sphere which is sprayed would be the same. Further, the coating deposition may be determined by the characteristics of the spray gun, distance of the gun, powder feed rate, speed of rotation of the holding fixture, speed of rotation of the component, and diameter of the holding fixture. Acceptable or optimum values for the variable one or ones of these items may be obtained by use of the algorithm or look-up table stored in the memory 19 along with specific input values, if desired. As a yet further example, it may be desirable to limit the total thickness of the sprayed material to a value which does not exceed a predetermined value. Such criteria may be desirable depending upon the spray material. For example, if the spray material is a ceramic type material, then a predetermined limit may be imposed on the total thickness; whereas if the spray material has a predetermined amount of metal (such as approximately 6% or more), then there may not be a predetermined practical limit on the total thickness of the spray material.

Figure 4A:
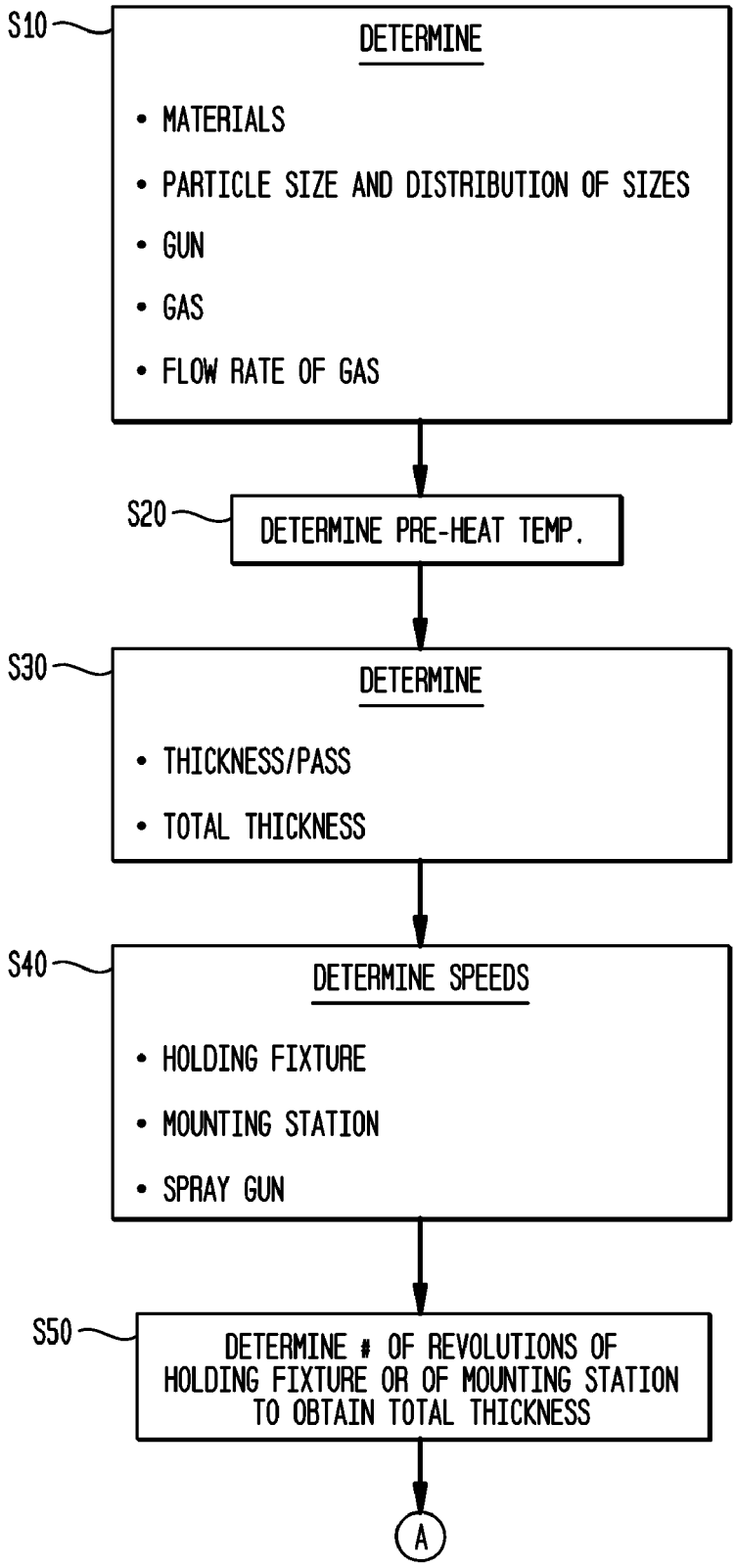
FIGS. 4*a* and 4*b* are flow charts to which reference will be made in explaining an operation of the present multi-station rotation system.
Figure 4B:
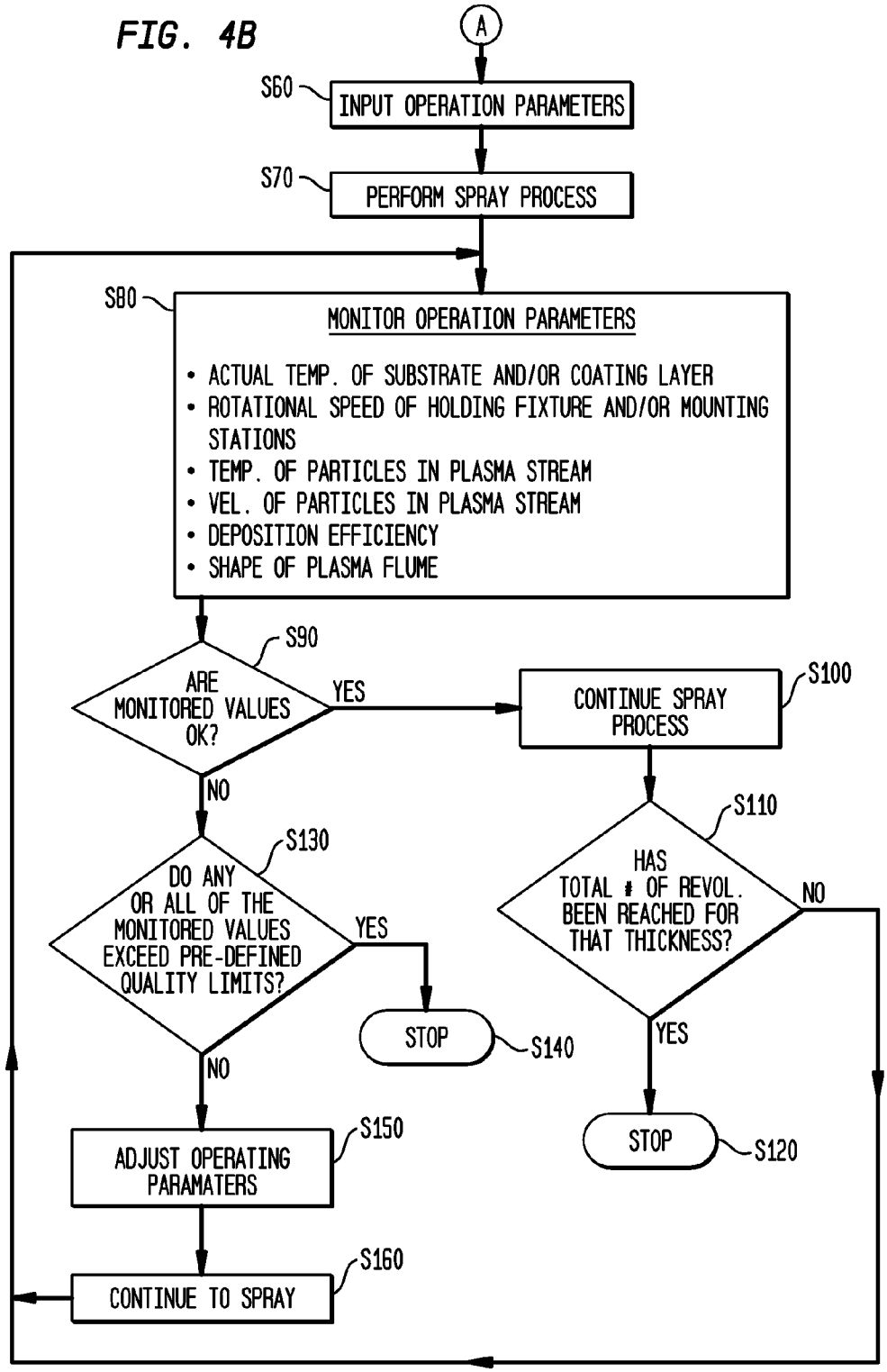

An overall operation summary will now be provided with reference to the flowchart of FIGS. 4*a* and 4*b*.

Initially, as indicated in step S10, a number of items may be determined. Such items may include the materials utilized for the substrate and/or spray particles, the size of the spray particles and the allowable distribution of such size, the particular spray gun, the gas to be utilized (such as argon, nitrogen, and so forth, or a blend thereof), and/or the gas flow rate. The selection of the spray gun may be influenced by a number of desired factors such as deposition efficiency, working distance, least amount of copper contamination from spray nozzle, longevity, and power consumption. Additionally, the gas flow rate may include the flow rate of the gas through the nozzle of the spray gun and/or the flow rate of the gas utilized for supplying the powder to the spray gun.

Additionally, and as indicated in steps S20 and S30, several parameters may be determined. For example, the pre-heat temperature, the thickness of coating material to be applied per pass, and the total thickness of spray material to be applied may be determined.

As indicated in step S40, velocities or speeds associated with several items of the system may be determined. For example, the rotational speed of the holding fixture 12, the rotational speed of any one or ones of the mounting stations 14, and/or the speed of the spray gun may be determined. The rotational speed of the holding fixture 12 and the rotational speed of any one or ones of the mounting stations 14 may be determined by use of equations 2 and 3, respectively.

As indicated in step S50, the number of revolutions of the holding fixture 12 or of the mounting station to obtain the total thickness of the spray material may be determined.

Upon determining operational parameters or commands, such items may be supplied as inputs to the system 10, as indicated in step S60.

After the operational parameters and/or commands are inputted, the spray process may be initiated as indicated in step S70.

While the spray process is being performed, one or more operational parameters may be monitored, as indicated in step S80. For example, the actual temperature(s) of the substrate and/or the coating layer of one or more of the components, and/or the actual rotational speed(s) of the holding fixture 12 and/or one or more of the mounting stations 14 (or components 13) may be monitored such as in a manner as previously described. Additional operating parameters may also be monitored. For example, parameters such as the temperature of the particles in the plasma stream, the speed of the particles in the plasma stream, the deposition efficiency, and/or the shape of the plasma flume may be monitored.

The values of the monitored parameters may be supplied to the control device 18 and analyzed thereat so as to determine if such values are acceptable, as indicated in step S90. If such values are acceptable, then the spray process may continue as indicated in step S100. Afterwards, as indicated in step S110, a determination may be made as to whether the total number of revolutions of either the holding fixture 12 or the mounting station(s) has been reached such that the desired total thickness of the coating material has been obtained. If such number of revolutions has been reached, then the spray process may stop as indicated in step S120. However, if the total number of revolutions has not been reached, then processing may return to step S80.

On the other hand, if the determination in step S90 indicates that the monitored values are unacceptable, then a determination may be made as to whether any of such values exceed pre-defined limits which may affect the quality of the component(s), as indicated in step S130. If the determination indicates that any of such values exceed the pre-defined limits or are unacceptable, then the spray process may be stopped and the component(s) scrapped as indicated in step S140. If, on the other hand, the determination indicates that none of these values exceed the pre-defined limits or are unacceptable, then the operating parameters may be adjusted in a manner such as that previously described and the spray process may continue, as indicated in steps S150 and S160. Thereafter, processing may return to step S80.

Thus, the present invention provides a technique whereby a plurality of components (such as medical implant components) may be simultaneously (or substantially simultaneously) sprayed with a desired material. Such spray process may be a thermal type spray process such as plasma or a high velocity oxygen fuel (HVOF) spray process. Alternatively, other types of spraying processes may be utilized, such as a cold temperature spray process or a high velocity spray process such as that described in co-pending application Ser. No. 11/325,790, filed Jan. 5, 2006, entitled "High Velocity Spray Technique For Medical Implant Components" by inventors Lawrynowicz et al., which is hereby incorporated by reference. Further, the present technique provides a technique whereby a spray process may be performed while obtaining a desired condition or conditions (such as self regulating temperature control or a thickness per pass which does not exceed a predetermined value) easily and at a relatively low cost. Furthermore, the present technique enables relatively high deposition efficiency to be obtained, and may be applicable to components having varied geometries or shapes.

Further, although the present invention has been described with certain elements, the present invention is not so limited. For instance, although the motors have been described as possibly being either a DC type or an AC type motor, the present invention is not so limited. Alternatively, one or both of such motors may be other types of motors, such as a stepper motor.

Figure 5:
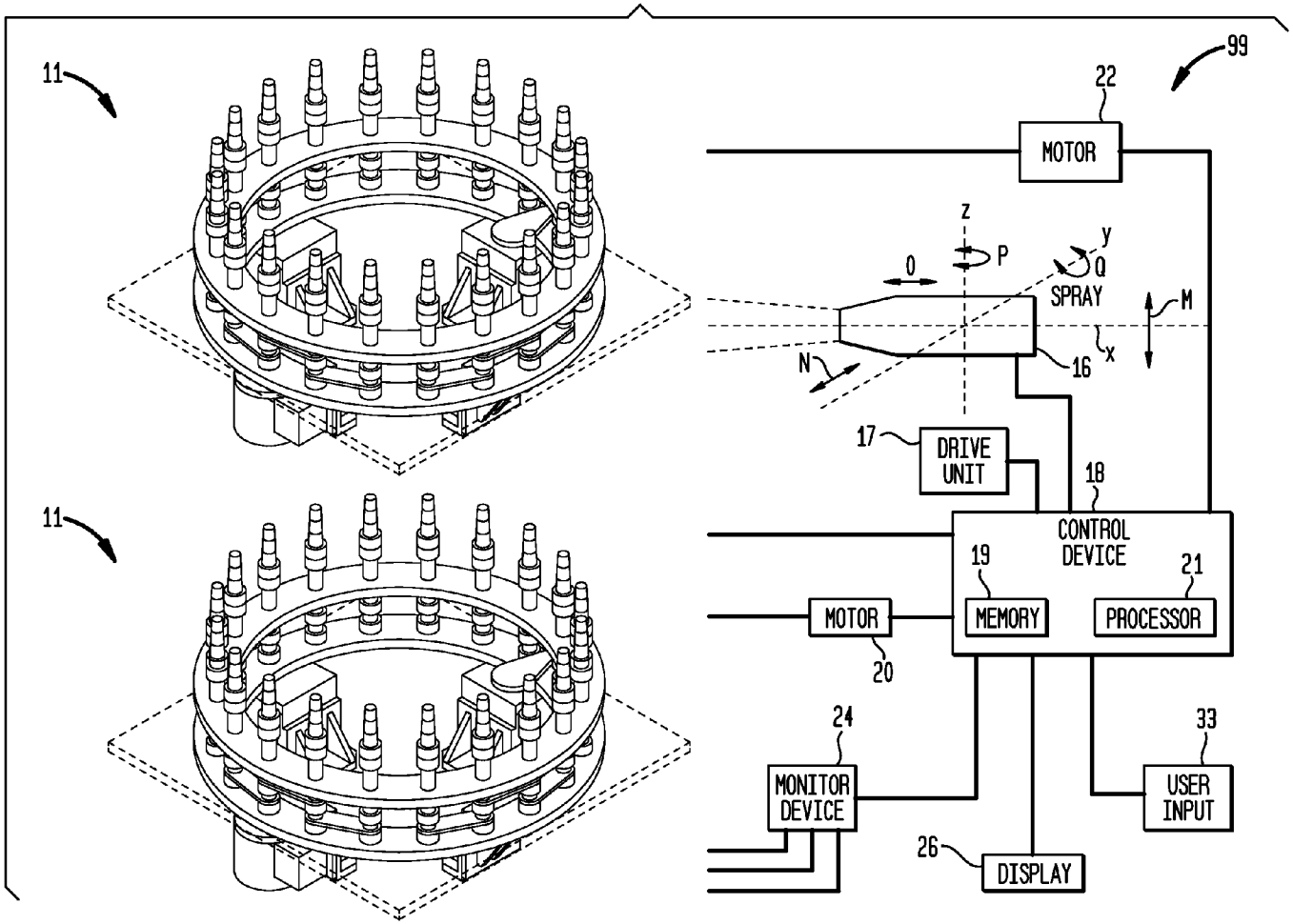
FIG. 5 is a diagram of a multi-station rotation system according to another embodiment of the present invention.

As another example, although the system 10 was described as having one holding assembly 11, the present invention is not so limited. For example, the present system may have two or more such holding assemblies as shown in FIG. 5. Such system may include one or more spray and monitor assemblies 99. Each assembly 99 may include a spray device 16, a drive unit 17, control device 18, one or more monitor devices 24, user input 33, display 26, and motors 20 and 22 which may be arranged and operated in a manner such as that previously described with regard to the system 10 illustrated in FIG. 1. If such system has only one spray device, then the system may be configured such that either the spray device moves to each of the holding fixtures or the holding fixtures move to the spray device. Alternatively, the system of FIG. 5 may omit a number of the items in the assembly 99 and/or may include more than one of any or all of the items. For example, the system of FIG. 5 may include two spray devices and two drive units and one of the remaining items of the assembly 99. In such situation, one spray device 16 may be arranged for each holding assembly 11.

As yet another example, although the connections between several of the devices were described as being wired type connections, the present invention is not so limited. Instead, any or all of such connections could be wireless type connections.

Figure 6:
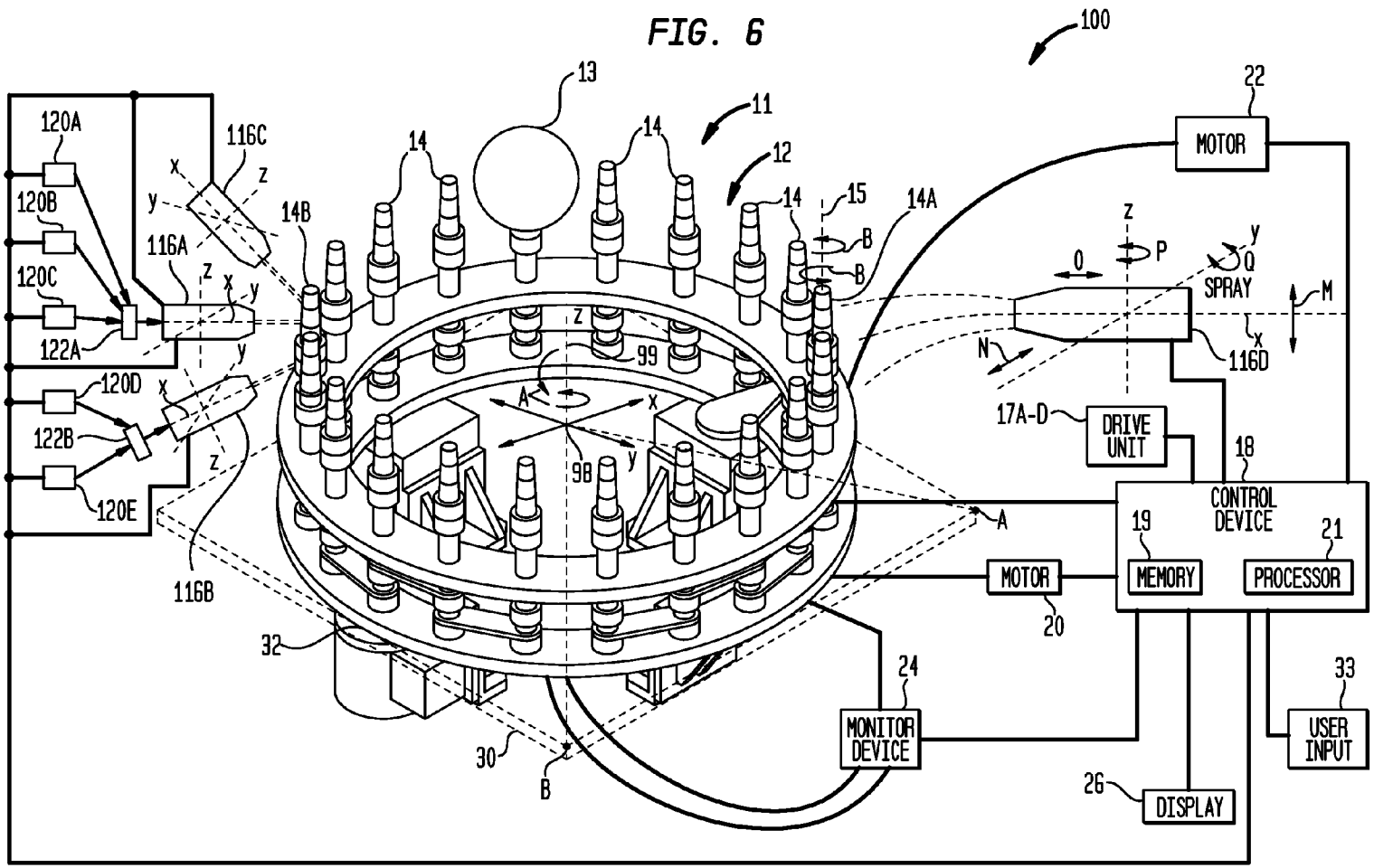
FIG. 6 is a diagram of a multi-station rotation system according to a further embodiment of the present invention.

In still another example, referring to FIG. 6, a system 100 may include a single holding assembly 11, as described above with reference to the system 10, and a plurality of spray devices 116, where one or more of the spray devices 116 may be supplied with material to be sprayed from one or more feeders 120. Referring to FIG. 6, the system 100 may include one or more monitor devices 24, user input 33, display 26 and motors 20 and 22, which may be arranged and operated in a manner such as that previously described with regard to the system illustrated in FIG. 1. In addition, the system 100 may include drive units 17 coupled to respective spray devices 116, and a control device coupled to the motors 20 and 22, the display 26, the user input 33 and the drive units 17, as in the system 10, and also to the spray devices 116 and the feeders 120. Further, one or more hoppers 122 may couple one or more of the feeders 120 to one or more spray devices 116.

In the exemplary embodiment illustrated in FIG. 6, the system 100 includes the spray devices 116A-116D, the hopper 122A coupling the feeders 120A, 120B, 120C to the spray device 116A, and the hopper 122B coupling the feeders 120D and 120E to the spray device 116B. In addition, the drive units 17A-17D are coupled to the spray devices 116A-116D, respectively.

The feeders 120 may be containers in which sprayable material may be stored, and which may be electronically controlled to permit release of the stored material from the container upon receipt of an electronic control signal, such as from the control device 18. The released material may flow out of one or more outputs of the feeder, which may be suitably coupled to a hopper or a spray device. The feeder may include an electronically controllable valve that may be controlled to provide that a desired amount of material in the container is released and flows from the output of the feeder per unit time.

The hoppers 122 may be material storage apparatuses, which may receive material at one or more supply inlets, which may be coupled to one or more flow paths, such as outlets of one or more feeders. The hoppers 122 may have one or more outlets through which the material may exit the hopper. An outlet of the hopper may be connected to one or more spray devices.

The drive units 17 may be operable for controlling movement of the respective spray devices 116 to which the drive units 17 are connected, similarly as described above for the system 10, based on control signals, such as supplied by the control device 18.

The spray devices 116 may be constructed and operate similarly as the spray device 16 described above, and desirably may have a storage reservoir for holding the materials to be sprayed. The spray devices 116A and 116B may have a storage reservoir for receiving materials from one or more outlets of a hopper or a feeder.

The control device 18 may provide control signals and supply the same to the spray devices 116 for controlling, for example, the rate at which material is sprayed, the temperature of the material when the material is sprayed, the time or duration of spraying, and/or other operational parameters of one or more of the spray devices 116.

In addition, the control device 18 may provide control signals and supply the same to one or more the feeders 120, whereupon the feeders may operate accordingly. For example, the control signals may control the rate at which material is supplied from one or more outlets of the feeder, the time or duration the material is being supplied from one or more outlets of the feeder, and/or other operational parameters of the feeder.

In the exemplary embodiment of the system 100 illustrated in FIG. 6, the spray devices 116C and 116D are not connected to feeders, the spray device 116A is coupled to the feeders 120A, 120B, 120C via the hopper 122A, and the spray device 116B is coupled to the feeders 120D and 120E. In addition, the spray devices 116A-116D are positioned, in relation to the stationary housing 30 and the rotatable fixture 12, such that the spray device 116D may spray material in the direction of a first region above the housing 30 and each of the spray devices 116A, 116B, 116C may spray material in the direction of a second region above the housing 30, where the first and second regions are different. For example, referring to FIG. 6, which shows the rotatable fixture 12 at an exemplary position for an instant in time during the rotation thereof, the spray device 116D is positioned such that the spray device 116D may be controlled to spray material onto the component mounted on the station 14A, which is located at the first region at the time instant, and the spray devices 116A, 116B and 116C are positioned such that the spray devices 116A, 116B and 116C may be controlled to spray material(s) onto the component mounted on the station 14B, which is located at the second region at the same time instant, where the stations 14A and 14B are diametrically opposed to each other on the rotatable fixture 12. It is to be understood that, in accordance with the present invention, one or more of the spray devices 116 may be positioned at any position in relation to the rotatable fixture 12, such that spray material may be sprayed selectively in the direction of one or more stations 14 from one or more spray devices 116 at any instant. In addition, the material sprayed by one or more of the spray devices 116 may be different than, or at a different temperature from, the material sprayed by one or more of the other spray devices 116.

In a further embodiment, one or more of the spray devices 116 may be moveable in relation to the stationary housing 30, such that one or more of the spray devices 116 may be controlled to spray one or more regions above the housing while the fixture 12 is rotating. For example, referring to FIG. 6, one or more of the spray devices 116, such as the spray device 116D, may, at a first time instant during rotation of the fixture 12, spray in the direction of the station 14 located nearest to a point A on the housing 30, and at a second, subsequent time instant during rotation of the fixture 12, spray in the direction of the station 14 located nearest to a point B, where the points A and B are on radial lines which extend through the center 98 of the fixture 12 and are orthogonal to each other.

In another aspect of the invention, a system including multiple spray devices and multiple feeders coupled to one or more of the spray devices, such as described above for the system 100, may be used for coating a component, such as, for example, a medical component and, more particularly an artificial joint, such as a femur ball or cup for an artificial hip joint. In one embodiment, a system 100A may include spray devices 116A, 116B and 116C coupled directly to feeders 120A, 120B, 120C, respectively, and have a plurality of components 13 mounted on the respective stations 14 of the fixture 12, as depicted in the operating scenario shown in FIG.

7A. In a desired embodiment, the positions of the spray devices 116A, 116B and 116C may be fixed in relation to each other and the rotatable fixture 12, such that the spray devices 116A, 116B, and 116C may spray material only in the directions indicated by arrows AA, BB and CC, respectively. The feeders 120A, 120B, 120C may contain different respective powders that may be sprayed onto the components 13 mounted on the fixture 12. In a desired embodiment, the feeder 120A may include a powder material composition A including one composition having a coefficient of thermal expansion which is closer to the coefficient of thermal expansion of an uncoated base surface of a component to be sprayed using the system 100A than the coefficients of thermal expansion of powder material compositions to be sprayed onto the component by the spray devices 116B and 116C. In addition, the feeder 120B may include a powder material composition B having a coefficient of thermal expansion which is intermediate the coefficients of thermal expansion of the powder material compositions contained within the feeders 120A and 120C, and to be sprayed from the spray devices 116A and 116C, respectively. Further, the feeder 120C may include a powder material composition C having a coefficient of thermal expansion which is higher than the coefficients of thermal expansion of the powder material compositions contained within the feeders 120A and 120B, and to be sprayed from the spray devices 116A and 116B, respectively.

In another desired embodiment, the coefficient of thermal expansion of an uncoated base surface of a component to be sprayed using the system 100A is greater than the coefficients of thermal expansion of powder material compositions A, B and C to be sprayed onto the component by the spray devices 116A, 116B and 116C, respectively. In addition, the coefficient of thermal expansion of the powder material composition A is greater than the coefficient of thermal expansion of the powder material composition B and the coefficient of thermal expansion of the powder material composition C. Also, the coefficient of thermal expansion of the powder material composition B is greater than the coefficient of thermal expansion of the powder material composition C.

In one embodiment, the powder composition C in the feeder 120C may be a ceramic or ceramic composite that does not contain any metallic phases, and has a greater hardness than the hardness of the powder composition in the feeders 120A and 120B.

In one exemplary operation of the system 100A for the above-described embodiment and including the use of the powders A, B, C, having the coefficients of thermal expansion as described above, the fixture 12 is rotated about the central axis 99, and the feeders 120 and the spray devices 116 are operated by the control device 18 such that the powders A, B and C are sequentially sprayed onto an outer surface of each of the components while the individual components are continuously rotating about the respective axes 97. The sequential spraying of the powders A, B, C forms a coating layer on each of the components having a bottom layer of coating of the powder A on an uncoated base surface of the component, a coating layer of the powder B over the coating layer formed by the spray of the powder A, and a coating layer of the powder C over the coating layer formed by the spray of the powder B, or a top surface layer of the powder C. The coating layer of the powder B, therefore, is an intermediate coating layer between the bottommost layer formed from the powder A and topmost layer formed from the powder C.

In another exemplary operation of the system 100A for the above-described embodiment and including the use of the powders A, B, C, having the coefficients of thermal expansion as described above, the individual components are continuously rotating about the respective axes 97, and the fixture 12 may be rotated step-wise or in an indexed fashion, such that a component, for a predetermined time interval, is positioned opposite the spray device 116A, then opposite the spray device 116B, and then opposite the spray device 116C. In an exemplary process for coating a component, in a first step-wise position of the fixture 12 where the components 13A, 13B and 13C have not yet been sprayed, powder A from the feeder 120A is supplied to the spray device 116A, which is controlled to spray the powder A onto the component 13A so as to form a bottom layer of coating of the powder A on the uncoated base surface of the component 13A. At the first position of the fixture 12, the spray devices 116B and 116C do not spray material. Then, the fixture 12 is rotated to a second step-wise position, so that the component 13A is positioned opposite the spray device 116B. At the second position, powder B from the feeder 120B is supplied to the spray device 116B, which sprays the powder B onto the component 13A so as to form a coating layer of the powder B over the coating layer formed by the spray of the powder A. At the second position of the fixture 12, the spray devices 116A and 116C do not spray material. The fixture 12 is then rotated to a third step-wise position, so that the component 13A is positioned opposite the spray device 116C. At the third position, powder C from the feeder 120C is supplied to the spray device 116C, which sprays the powder C onto the component 13A to form a coating layer of the powder C over the coating layer formed by the spray of the powder B.

An advantage of sequentially applying coating layers having different coefficients of thermal expansion ("COEs") to a component, and in particular to a component having a dome-shaped area on one end such as a cup or ball of an artificial hip joint component, as discussed for the above exemplary embodiment, such that the COEs of the coating layers on the component gradually change from an interface between a base surface of the component and the bottommost coating layer to the topmost coating layer, is that residual stress is minimized, especially for a composition coating on the component having a thickness greater than about 300 microns.

In one embodiment, the outer surface of the component on which the powder A is to be applied may have the composition CoCrMo, and the powders A, B, C may have the compositions CoCrMo, 35% $Cr_3C_2$ and 65% CoCrMo, and $Cr_3C_2$, respectively. In a further embodiment, the powders A, B, C may be sprayed onto the component 13 at a sufficient temperature, such that the powders are melted when contacting the component or a coating layer already on the component. The rotation of the individual components 13 about their respective axes, in accordance with aspects of the present invention, advantageously provides that the sprayed powder forms a uniform coating layer on the outermost, exposed surface of the component.

In one embodiment, the spray devices 116A, 116B, 116C of the system 100A may be controlled to sequentially spray powders therefrom onto a component, similarly as described above, and also to spray a desired amount of powder, to attain a desired composition gradient coating on the component.

Figure 7A:
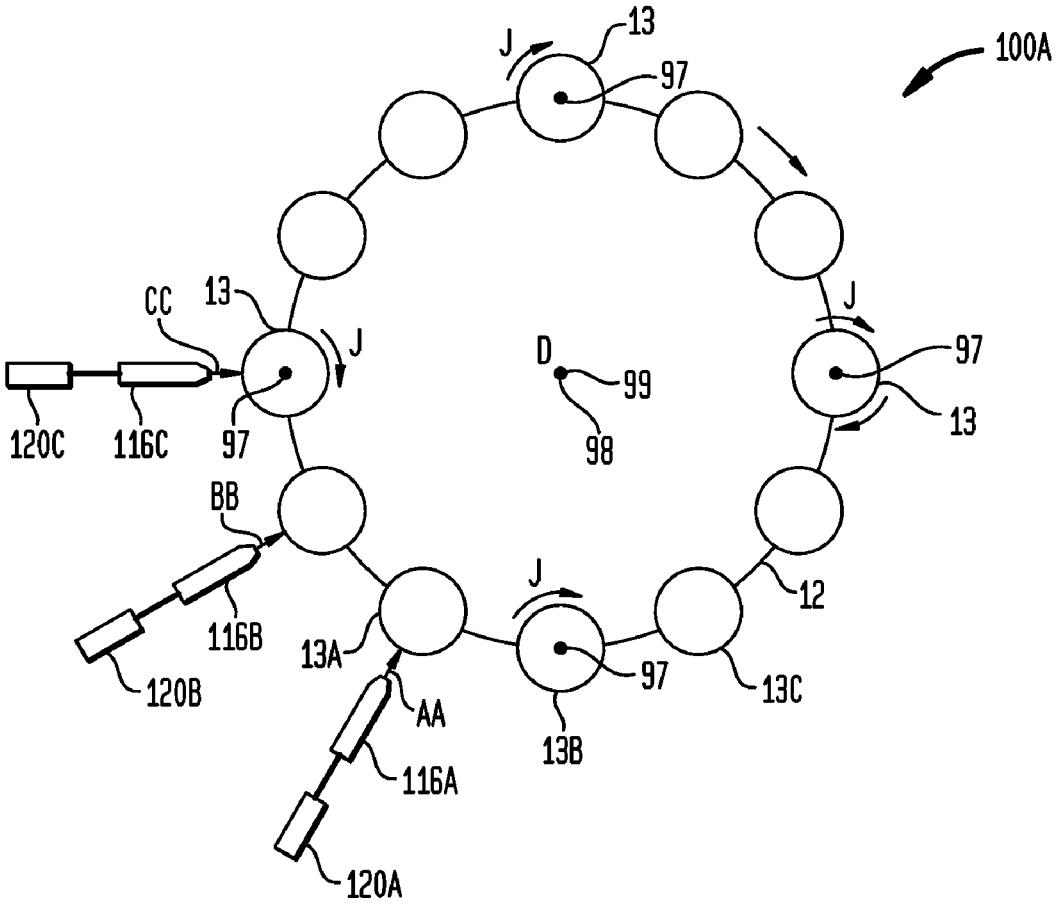
FIGS. 7A and 7B are diagrams to which reference will be made in explaining positioning of spray devices and use of feeders.

In another embodiment, the spray devices 116A, 116B, 116C may be operated to simultaneously spray powder at each step-wise position of the fixture 12. For example, referring to FIG. 7A, in the third step-wise position of the fixture 12 as described above, where the components 13A, 13B and 13C are positioned opposite the spray devices 116C, 116B and 116C, respectively, the spray device 116C may spray the powder C onto the component 13A, which already had been sprayed with the powders B and A when previously positioned opposite the spray devices 116B and 116A, respectively, at the second and the first step-wise positions, respectively; the spray device 116B may spray the powder B onto the component 13B, which already had been sprayed with the powder A when previously positioned opposite the spray device 116C at the second step-wise position; and the spray device 116C may spray the powder A onto the component 13C.

Figure 7B:
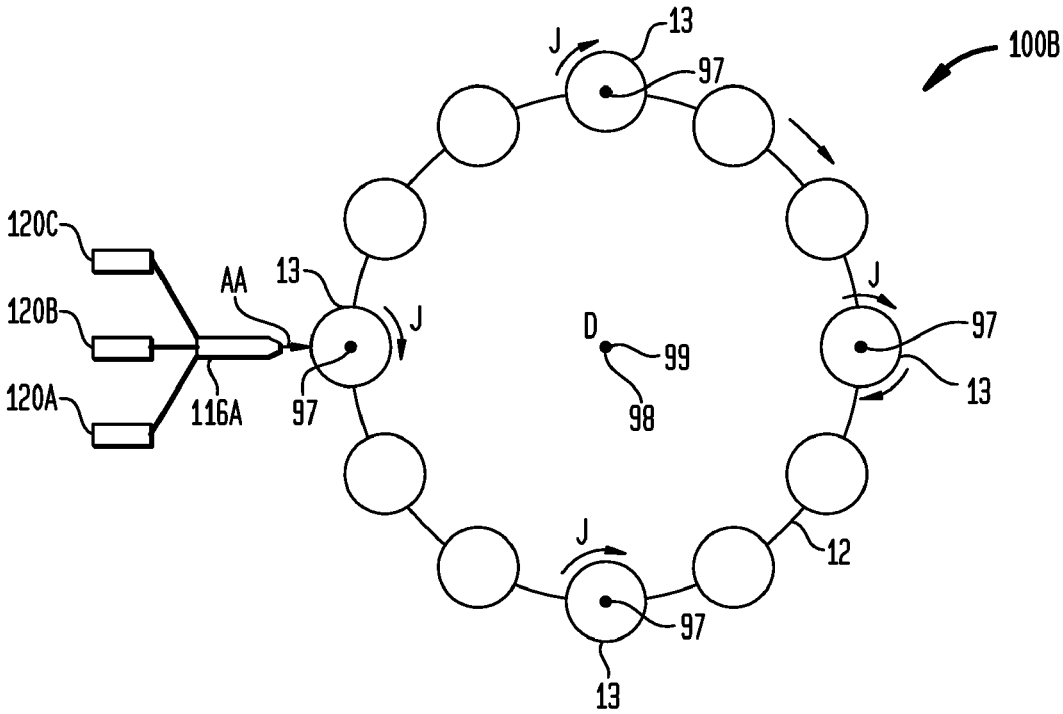

In another embodiment, a system 100B may include a spray device 116A coupled to feeders 120A, 120B, 120C and have a plurality of components 13 mounted on the respective stations of the fixture 12, as depicted in the operating scenario shown in FIG. 7B. The position of the spray device 116A may be fixed in relation to the rotatable fixture 12, such that the spray device 116A may spray material only in the direction indicated by arrow AA. The feeders 120A, 120B, 120C may contain the same powders or different respective powders, which are maintained at the same or different respective temperatures. In one embodiment, the powders in the feeders 120A, 120B, 120C may have the compositions CoCrMo, 35% Cr3C2 and 65% CoCrMo, and $Cr_3C_2$, respectively, and the outer surface of the component on which the powder from the feeder 120A is to be applied may have the composition CoCrMo. In an exemplary operation of the system 100B, the powders from the feeders 120A, 120B, 120C are sequentially supplied to the spray device 116A, and the spray device 116A is controlled to spray the powders from the feeders 120A, 120B, 120C sequentially onto an outer surface of each of the components while the component is rotating about the axis of the mounting station on which the component is mounted. In one embodiment, all of the components on the fixture 12 are sprayed with the powder of the feeder 120A, then with the powder of the feeder 120B and finally with the powder of the feeder 120C. In one embodiment, the spray device 116A in the system 100B may be a plasma or HVOF spray device.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A system for use in applying a coating of a desired material onto at least one component, said system comprising:

a plurality of thermal sprayers;

a rotatable holding fixture having a plurality of mounting stations, each of the mounting stations being operable to securely hold at least one component, wherein the fixture is operable to rotate about a central axis and each of the mounting stations being operable to rotate about a respective mounting station axis, wherein the central axis of the fixture is removed from the mounting station axes of the respective mounting stations of the fixture, wherein each of the plurality of thermal sprayers is operable to spray at least one desired material upon at least one of the components, and wherein the fixture is operable to rotate about its central axis while simultaneously therewith at least one of the mounting stations having a respective component rotates about its respective mounting station axis; and a control device to control rotational speed of the fixture and to control rotational speed of a number of the mounting stations such that a ratio of the rotational speed of the fixture to the rotational speed of the number of the mounting stations is a whole integer to avoid build-up of sprayed desired material on a substrate or substrates of the respective component or components, in which a minimum rotational speed of the fixture is defined as follows:

minimum rotational speed of the fixture=(linear speed of component)/($\pi$)(diameter $D$)

wherein the linear speed of the component represents a speed at which cracking of a coating layer on the outer surface thereof is avoided during the operation, and the diameter D is equal to twice a distance from a center of a respective mounting station to a center of the fixture, and in which the rotational speed of the respective mounting station is defined as follows:

mounting station rotational speed=$n(\pi)(D/w)$(the fixture rotational speed)

wherein D is equal to twice the distance from the center of the respective mounting station to the center of the fixture, w represents a diameter or width of a flame of particles projected from the thermal sprayer, and n represents a number of revolutions of the respective component while the respective component crosses a path of the flame during a single revolution of the fixture.

2. The system of claim 1, wherein the component is a medical implant.

3. The system of claim 1, in which the control device is operable to control operation and movement of at least one of the plurality of thermal sprayers.

4. The system of claim 1 further comprising:

one or more speed monitoring devices operable to monitor a rotational speed of at least one of the fixture or at least one of the mounting stations.

5. The system of claim 1 further comprising:

one or more temperature monitoring devices operable to monitor a temperature of one or more of the components.

6. A method for applying a coating of a desired material onto at least one component comprising:

rotating a rotatable holding fixture about a central axis, wherein the fixture is adapted for securely holding a plurality of components on respective mounting stations, wherein the central axis of the fixture is removed from mounting station axes of the respective mounting stations;

rotating at least one of the mounting stations having the respective component secured thereto about the respective station axis; and operating a plurality of thermal sprayers to spray at least one desired material upon at least one of the components, while the respective mounting station onto which the at least one component is secured is rotating about its station axis, wherein at least one of the plurality of thermal sprayers is operated to sequentially spray at least one first material, at least one second material and at least one third material onto at least one of the components, and wherein the first, second and third materials include at least one composition having first, second and third coefficients of thermal expansion ("COE"), respectively, wherein the first COE is less than the second and third COEs, wherein the second COE is between the first and third COEs, and wherein an outer surface of the at least one component onto which the at least first material is sprayed has a COE closer to the first COE than to the second COE.

7. The method of claim 6, wherein the fixture is rotated about the central axis in a plurality of steps, wherein the fixture is stationary for a predetermined interval between successive steps, wherein the fixture is rotated such that each of the components is positioned during three intervals in relation to the at least one of the plurality of thermal sprayers to permit spraying of material by the at least one of the plurality of thermal sprayers onto each of the components; and wherein the at least one of the plurality of the thermal sprayer is operated to sequentially spray the at least one first material, the at least one second material and the at least one third material onto each of the components during the respective three intervals in which each of the components is positioned to permit spraying of material by the at least one of the plurality of thermal sprayers onto each of the components.

8. The method of claim 6, wherein the first, second and third materials are sprayed, respectively, from first, second and third thermal sprayers of the plurality of thermal sprayers.

9. The method of claim 6 further comprising:

supplying the first, second and third materials to the at least one of the plurality of thermal sprayers from first, second and third feeders, respectively.

10. The method of claim 6, wherein the components are medical implant components.

11. A method for applying a coating of a desired material onto at least one component comprising:

rotating a rotatable holding fixture about a central axis, wherein the fixture is adapted for securely holding a plurality of components on respective mounting stations;

rotating at least one of the mounting stations about a respective station axis, wherein the central axis of the fixture is removed from the mounting station axes of the respective mounting stations;

supplying a plurality of desired materials from a respective plurality of feeders to a thermal sprayer; and operating the thermal sprayer to spray the plurality of desired materials onto at least one of the components, while the respective mounting station onto which the at least one component is secured is rotating about its station axis, wherein the thermal sprayer is operated to sequentially spray at least one first material, at least one second material and at least one third material supplied, respectively, from first, second and third of the feeders onto at least one of the components, and wherein the first, second and third materials include at least one composition having first, second and third coefficients of thermal expansion ("COE"), respectively, wherein the first COE is less than the second and third COEs, wherein the second COE is between the first and third COEs, and wherein an outer surface of the at least one of the components onto which the at least first material is sprayed has a COE closer to the first COE than to the second COE.

12. A method for applying a coating of a desired material onto at least one component comprising:

rotating a rotatable holding fixture about a central axis, wherein the fixture is adapted for securely holding a plurality of components on respective mounting stations;

rotating at least one of the mounting stations about a respective station axis, wherein the central axis of the fixture is removed from the mounting station axes of the respective mounting stations;

supplying a plurality of desired materials from a respective plurality of feeders to a thermal sprayer; and operating the thermal sprayer to spray the plurality of desired materials onto at least one of the components, while the respective mounting station onto which the at least one component is secured is rotating about its station axis, wherein the thermal sprayer is operated to sequentially spray at least one first material, at least one second material and at least one third material supplied, respectively, from first, second and third of the feeders onto at least one of the components, and wherein the first, second and third materials include at least one composition having first, second and third coefficients of thermal expansion ("COE"), respectively, wherein an outer surface of the at least one of the components onto which the at least first material is sprayed has a COE greater than the first, second and third COEs, wherein the first COE is greater than the second and third COEs, and wherein the second COE is greater than the third COE.

13. The method of claim 12, wherein the fixture is rotated about the central axis in a plurality of steps, wherein the fixture is stationary for a predetermined interval between successive steps, wherein the fixture is rotated such that each of the components is positioned during three intervals in relation to the thermal sprayer to permit spraying of material by the thermal sprayer onto each of the components; and wherein the thermal sprayer is operated to sequentially spray the at least one first material, the at least one second material and the at least one third material onto each of the components during the respective three intervals in which each of the components is positioned to permit spraying of material by the thermal sprayer onto each of the components.

14. The method of claim 11, wherein the components are medical implant components.

15. The method of claim 11, wherein the desired material in one of the feeders is different from the desired material in another of the feeders.

16. The method of claim 11, wherein the desired material in one of the feeders is at a different temperature than the desired material in another of the feeders.

* * * * *